US010294704B2

(12) United States Patent
Lang et al.

(10) Patent No.: US 10,294,704 B2
(45) Date of Patent: May 21, 2019

(54) ADJUSTABLE HINGE AND METHOD OF ADJUSTMENT

(71) Applicant: Mammoth Industries Pty Ltd, Thomastown, Victoria (AU)

(72) Inventors: Craig Cameron Lang, Eltham (AU); Robert James, Thomastown (AU)

(73) Assignee: MAMMOTH INDUSTRIES PTY LTD, Thomastown, Victoria (AU)

( * ) Notice: Subject to any disclaimer, the term of this patent is extended or adjusted under 35 U.S.C. 154(b) by 0 days.

(21) Appl. No.: 15/517,050

(22) PCT Filed: Oct. 9, 2015

(86) PCT No.: PCT/AU2015/000603

§ 371 (c)(1),
(2) Date: Apr. 5, 2017

(87) PCT Pub. No.: WO2016/054678

PCT Pub. Date: Apr. 14, 2016

(65) Prior Publication Data

US 2017/0298668 A1 Oct. 19, 2017

(30) Foreign Application Priority Data

Oct. 10, 2014 (AU) ..... 2014904053

(51) Int. Cl.
*E05D 5/12* (2006.01)
*E05D 7/04* (2006.01)
(Continued)

(52) U.S. Cl.
CPC ..... *E05D 11/0018* (2013.01); *E05D 7/04* (2013.01); *E05D 15/0639* (2013.01);
(Continued)

(58) Field of Classification Search
CPC ..... Y10T 16/364; Y10T 16/35; Y10T 16/381; Y10T 16/3813; Y10T 16/246;
(Continued)

(56) References Cited

U.S. PATENT DOCUMENTS 778,107 A * 12/1904 Burks ..... F16B 39/16
411/223
1,336,780 A * 4/1920 Hickey ..... E05D 7/0027
16/244
(Continued)

FOREIGN PATENT DOCUMENTS

AU 749753 B2 3/2000
AU 2013203730 A1 12/2013
(Continued)

OTHER PUBLICATIONS

International Search Report dated Nov. 18, 2015 for corresponding International Patent Application PCT/AU2015/000603 filed on Oct. 9, 2015.
(Continued)

*Primary Examiner* — Chuck Y Mah
(74) *Attorney, Agent, or Firm* — David D. Brush; Westman, Champlin & Koehler, P.A.

(57) ABSTRACT

The present invention relates to the field of hinges and carriage mechanisms, such as a hinge and carriage mechanism adapted to hang a door, gate, panel, window or the like. The present invention is suitable for use with a means of providing height adjustment for a door and can reduce undesirable tampering and improve the security of the hinges and door assemblies by controlling the orientation of specific part of a hinge to limit access to the fastener.

4 Claims, 3 Drawing Sheets

(51) Int. Cl.

| | |
|---|---|
| ***A47H 15/00*** | (2006.01) |
| ***E05D 11/00*** | (2006.01) |
| ***E05D 15/06*** | (2006.01) |
| ***E05D 15/26*** | (2006.01) |

(52) U.S. Cl.
CPC ..... *E05D 15/26* (2013.01); *E05Y 2600/14* (2013.01); *E05Y 2900/132* (2013.01)

(58) Field of Classification Search
CPC ..... Y10T 16/243; E05D 11/0018; E05D 7/04; E05D 7/0415; E05D 7/0423; E05D 2007/0469; E05D 15/0639; E05D 15/0634; E05D 15/26; E05Y 2600/14; E05Y 2900/132
See application file for complete search history.

(56) References Cited

U.S. PATENT DOCUMENTS

| | | | | | |
|---|---|---|---|---|---|
| 1,761,215 | A * | 6/1930 | Lamm | E05D 15/063 | 16/105 |
| 2,779,966 | A * | 2/1957 | Torchia | E05D 7/0027 | 16/244 |
| 3,030,655 | A * | 4/1962 | Rudnick | E05D 7/0027 | 16/243 |
| 3,428,999 | A * | 2/1969 | Benson, Jr. | E05D 15/063 | 16/103 |
| 4,359,080 | A * | 11/1982 | Brydolf | E05D 15/26 | 160/183 |
| 5,568,673 | A * | 10/1996 | Ryczek | E05D 7/0027 | 16/244 |
| 7,293,329 | B2 * | 11/2007 | Heid | E05D 7/0027 | 16/245 |
| 8,677,564 | B2 * | 3/2014 | Pelekanos | E05D 15/26 | 16/105 |
| 8,695,165 | B2 * | 4/2014 | Pelekanos | E05D 15/26 | 16/105 |
| 2002/0162190 | A1 | 11/2002 | Spork et al. | | |
| 2006/0107490 | A1 | 5/2006 | Pacholke | | |
| 2013/0061427 | A1 * | 3/2013 | Lang | E05D 7/0423 | 16/248 |
| 2015/0368949 | A1 * | 12/2015 | Smith | E05D 15/0639 | 16/326 |

FOREIGN PATENT DOCUMENTS

| | | | | |
|---|---|---|---|---|
| AU | 2013203755 | A1 | 12/2013 | |
| AU | 2013203767 | A1 | 12/2013 | |
| WO | WO-9736075 | A1 * | 10/1997 | E05D 15/063 |
| WO | 2013177609 | A1 | 12/2013 | |
| WO | 2014059477 | A1 | 4/2014 | |

OTHER PUBLICATIONS

Written Opinion of the International Searching Authority dated Nov. 18, 2015 for corresponding International Patent Application PCT/AU2015/000603 filed on Oct. 9, 2015.

* cited by examiner

ADJUSTABLE HINGE AND METHOD OF ADJUSTMENT

CROSS-REFERENCE TO RELATED APPLICATIONS

This Application is a Section 371 National Stage Application of International Application No. PCT/AU2015/000603, filed Oct. 9, 2015, which is incorporated by reference in its entirety and published as WO 2016/054678 on Apr. 14, 2016, in English.

FIELD OF INVENTION

The present invention relates to the field of hinges and carriage mechanisms.

In one form, the invention relates to a hinge and carriage mechanism adapted to hang a door, gate, panel, window or the like.

In one particular aspect the present invention is suitable for use as a means of providing height adjustment for a door.

It will be convenient to hereinafter describe the invention in relation to its application to a door, particularly a folding door, however it should be appreciated that the present invention is not limited to that use only and can be used for other types of doors, windows and other closures.

BACKGROUND ART

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

In prior art arrangements, a hinge is often used to 'hang' a door or window In other words, the hinge enables the door to move freely (open or close) by providing a pivot point about which an edge of the door can be rotated relative to a door frame or opening. The positioning of a hinge on the door or window frame also determines the height of the door or window, that is the relative spacing between the door or window frame and the door or window surface to ensure the door or window is relatively free to move. In practice, however, a person hanging a door or window will not get the door position correct, and some adjustment will be needed.

Folding doors often have several hinged panels, suspended and/or supported on roller carriages that run along a horizontal track attached to the lintel of a door frame defining an opening. Adjacent panels are typically connected by conventional hinges at their edges and are foldable between a closed configuration in which the panels align in a common plane to close an opening, and an open configuration in which the panels are stacked at one side of the opening.

It is necessary that the hinges can be adjusted to optimise the position of the door panels relative to the door frame and track to accommodate variations in the shape and alignment of the frame, track and panels during manufacture and installation.

With this in mind, various prior art hinges have been developed to incorporate mechanisms which enable adjustment of the vertical height of the door relative to the door frame, such as arrangements where the door is hung on the pivot pin.

Furthermore, existing hinges and their adjustment mechanisms can give rise to security issues, particularly when the bifold door or window is located at an exterior wall of a building. Parts of the hinge can be accessed from the exterior and manipulated or removed. Consequently, panels can be pushed out of alignment or removed to allow access into the building.

Another adjustment mechanism uses a threaded bolt. In this mechanism, the pivot pin comprises a threaded bolt (which forms a part of the pivot of the hinge) and which enables height adjustment by rotation of the threaded bolt relative to the hinge. However, it has been found that as the door is pivoted on the hinge, the threaded bolt also rotates, which has the undesirable effect of changing the height of the door as it opens and closes.

Australian patent AU-749753 (Centor Products Pty Ltd) discloses one type of adjustment mechanism comprising a pair of hinge leaves pivotally connected to a hinge pin, the upper end of the hinge pin being in threaded engagement with the carriage. The hinge pin can thus be turned clockwise or anticlockwise so that it moves along the thread to vary the distance between the hinge leaves and the carriage.

Australian patent applications AU-2013203730, AU-2013203755 and AU-2013203767 (CiiLock Engineering Pty Ltd) relate to relatively complex pivoting mechanisms for hinges, including adjustable hinges. The mechanism includes a bayonet-type locking system that is moved against a biasing means as the hinge pin is moved.

SUMMARY OF INVENTION

It is an object of the embodiments described herein to provide an improved adjustable hinge pin.

It is a further object of embodiments described herein to provide an adjustable hinge pin having improved security.

It is a further object of the embodiments described herein to overcome or alleviate at least one of the above noted drawbacks of related art systems or to at least provide a useful alternative to related art systems.

In a first aspect of embodiments described herein there is provided a hinge adapted for use in conjunction with a trolley adapted to travel along a track, the hinge comprising:

(a) at least one hinge leaf adapted to engage a proximate structure and rotate about a hinge pin, (b) the hinge pin having a first end depending from the trolley and a second end having an adjustment member for displacement of the at least one hinge leaf relative to the trolley, (c) a fastener for releasably fastening the adjustment member, and (d) a locking mechanism adjacent the second end of the hinge pin, wherein the locking mechanism is releasably fixable to limit access to the fastener.

Locking Mechanism

Preferably the locking mechanism is releasably fixable in a desired orientation to limit access to the fastener. For example, the locking mechanism may maintain the fastener in an orientation such that it is only accessible from one side when the panels are aligned in a common plane to close an opening. Alternatively the locking mechanism may maintain the fastener in an orientation such that it is only accessible when the folding door is open, with the panels stacked at one side of a door frame.

In one embodiment, the locking mechanism is removably attached to the second end of the hinge pin by a keyway and correspondingly shaped key, to ensure correct orientation. The keyway may for example, consist of a slot in the locking mechanism/hinge pin, with a correspondingly shaped key associated with the hinge pin/locking mechanism.

In another embodiment, one key is provided and can be fitted into either of two keyways. This provides a choice of orientations of the locking mechanism.

Fastener

Preferably the fastener is any convenient means for resisting movement of the adjustment member relative to the hinge pin. For example the fastener may be a set screw or 'grub screw'—a type of bolt with threaded screw grooves and a recessed drive port that fits an internal wrenching drive such as a hex (Allen) key, square (Robertson) wrench, or star (Torx) shaft twisting tool. However other types of suitable screws, bolts or the like will be readily apparent to the person skilled in the art.

Preferably the fastener is received within a threaded hole in the locking mechanism, one end of the fastener being adapted to exert compression or clamping force on the adjustment member.

Adjustment Member

The adjustment member for vertical displacement of the hinge pin is typically an externally threaded screw, such as a cap screw or cap bolt. In a particularly preferred embodiment the adjustment member is a socket head cap screw or Allen bolt, having a cylindrical head and a hexagonal drive hole. However a wide range of head and socket shapes would be suitable for use with the present invention.

Typically the adjustment member is received within a threaded recess coaxial with the second end of the hinge pin.

Hinge Pin

The hinge pin is an elongate pin of circular cross section which acts as an axle about which the hinge leaves rotate. Typically the first end of the hinge pin is received within the body of a trolley.

In a particularly preferred embodiment the first end of the hinge pin is integral with a trolley body. For example the axle may be press fitted to the trolley body. The cross-sectional profile of the hinge pin may be stepped or shaped to securely engage the trolley body. The hinge pin may have a head or other feature at the first end for resisting removal of the trolley and to support the weight of the hinge and proximate structure (such as a panel) to which it is attached.

Trolley

The trolley suitable for use in the present invention is typically of a type suitable for moving to and fro along a track, supporting one or more panels of a sliding door. The trolley typically includes a trolley body on which is mounted one or more rollers or wheels, typically two, four or six wheels. The hinge body typically includes a recess for receiving the first end of the hinge pin. It is important that the trolley is located at the optimal height to engage the track and ensure that the door is easy to slide.

Hinge Leaf

Where used herein the term 'hinge leaf' is intended to refer to the part of a hinge that directly or indirectly rotates about the hinge pin and is connected to a proximate structure such as a door panel, or door frame. A set of two or more hinge leaves comprises a hinge set. Typically the present invention will comprise at least two hinge leaves, preferably three or more hinge leaves.

Method

In another aspect of embodiments described herein there is provided a method of adjusting the aforementioned hinge, the method comprising the steps of:

(i) releasing the fastener from the adjustment member, (ii) operating the adjustment member to move the hinge pin vertically to a desired position, and (iii) applying the fastener to the secure the adjustment member.

Other aspects and preferred forms are disclosed in the specification and/or defined in the appended claims, forming a part of the description of the invention.

In essence, embodiments of the present invention stem from the realization that controlling the orientation of specific part of a hinge can reduce undesirably tampering and improve the security of the hinges and door assembly to which the hinges are applied.

Advantages provided by the present invention comprise the following:

Commonly available tools can be used to adjustment and optimise the hang of a door panel, particularly a folding door panel.

The location of the adjustment mechanism at the end of the hinge pin distant from the trolley and track enables easier, less cluttered access for adjustment.

The location of the fastener can be optimised to limit access and improve security.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which.

LIST OF PARTS

The following is a list of the parts referred to in the figures:

| | | | |
|---|---|---|---|
| 1 | Hinge pin | 13 | Adjustment member |
| 2 | Head of hinge pin | 14 | Threaded recess in hinge pin |

-continued

| | | | |
|---|---|---|---|
| 5 | Hinge pin keyway | 15a-b | Washers |
| 7 | Trolley | 21 | Fastener |
| 8 | Recess in trolley body | 25 | Locking mechanism |
| 10 | Hinge set | 27 | Key |
| 10a-c | Hinge leaves | 30 | Recess in locking mechanism |
| 12 | Retaining clip | 33 | Trolley wheel |
| 18 | Locking collar clip | 35a-b | Door panels |

DETAILED DESCRIPTION

The present invention relates to an adjustable pivot mount for a panel, typically a panel of a door, folding door and/or window or similar closure. The hinge of the present invention is typically used as the top or bottom mount for a panel that moves along a track. It is also important to note that the present invention maybe used for adjustment of the height of a panel, and/or adjustment of the lateral position of a panel. Embodiments described below relate primarily to height adjustment, but the present invention should not be construed as being so limited.

Figure 1:
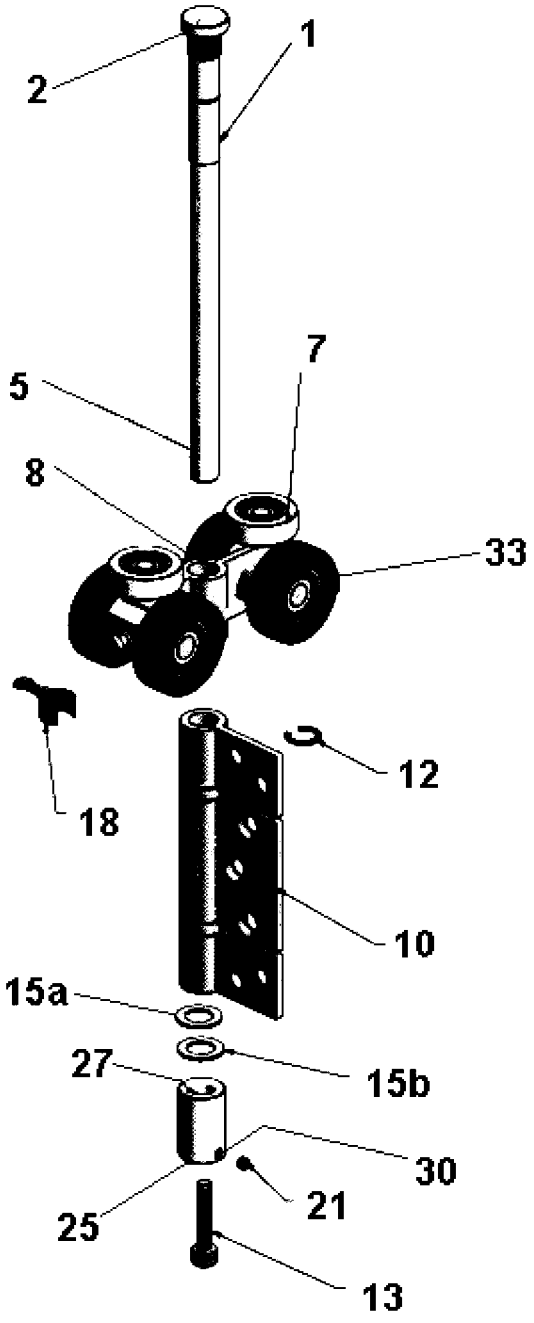
FIG. 1 illustrates an exploded view of the parts of the device of the present invention.

FIG. 1 is an exploded view of one embodiment of the present invention. The hinge comprises a trolley (7) adapted to travel along a track. Typically the track is attached to the top or bottom of a door frame, or to the floor or other horizontal structure of a building. A hinge pin (1) having a first end that terminates in an integral, expanded head (2), is received through a recess (8) the body of the trolley (7). The hinge pin (1) is press fit into the recess (8) and a retaining clip (12) is applied after the press fitting. The expanded head (2) of the hinge pin (1) stops the trolley (7) being pulled off the end of the hinge pin and can support significant panel weights.

The hinge pin (1) passes through a hinge set (10), in this embodiment comprising three hinge leaves (10*a*, 10*b*, 10*c*) that can rotate freely about the hinge pin (1). In use, the hinge leaves (10*a*, 10*b*, 10*c*) would be directly or indirectly attached to a proximate structure such as a door frame, door jamb, or door panels.

At the second end of the hinge pin (1) there is located an adjustment member (13) in the form of a socket head cap screw. The adjustment member (13) is rotatably received within a threaded recess (14) in the second end of the hinge pin (1) for vertical displacement of the hinge pin (1) relative to the hinge leaves (10*a*, 10*b*, 10*c*). Spacers such as stainless steel or nylon washers (15*a*, 15*b*) can be located intermediate the rotatable hinge leaves (10*a*, 10*b*, 10*c*) and the locking mechanism (25).

In this embodiment the locking mechanism (25) comprises a locking collar that includes a threaded recess (30) for receiving the fastener (21). In this embodiment the fastener comprises a grub screw which can be rotated into and out of the threaded recess (30) bringing it into and out of contact with the adjustment member (13).

The locking mechanism (25) in this embodiment is a locking collar, having an inside surface that comprises a key (27) that projects inwards. The key is shaped to be received in a keyway (5) in the form of a slot second end of the hinge pin (1). Thus, the orientation of the fastener (21) is dictated by the key being received in the keyway. Furthermore the locking mechanism cannot be rotated to change the orientation of the fastener (21) and thus the direction from which the fastener (21) can be accessed and unscrewed.

Figure 2:
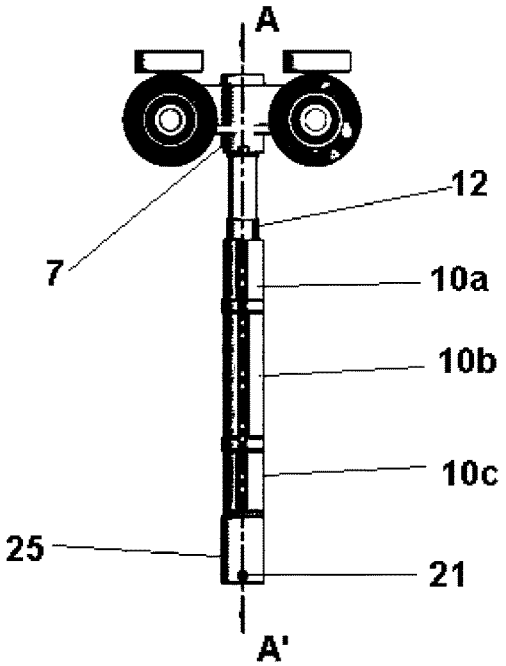
FIG. 2 is a side view of the assembled device of FIG. 1.

FIG. 2 is a side view of the device of FIG. 1 when fully assembled. In this view it can be seen that the longitudinal access of the fastener (21) is perpendicular to the direction of travel of the trolley (7). Thus the fastener (21) can only be accessed from one side of the door panels when aligned edge to edge. By virtue of the key/keyway interaction the locking mechanism (25) cannot be rotated to allow the fastener (21) to be accessed from the other side of the door panels.

Figure 3:
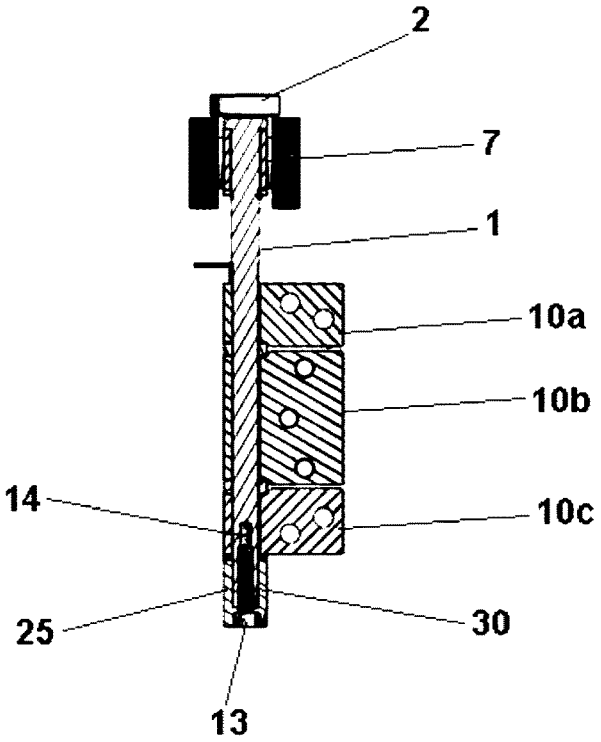
FIG. 3 is a plan view of a section through A-A' of FIG. 2.

FIG. 3 is a plan view of a section along the longitudinal axis of the hinge pin, that is, through A-A' of FIG. 2. In this view the threaded recess (14) in the hinge pin (1) can be clearly seen. The external thread of the adjustment member (13) engages the thread of the recess (14) to allow vertical adjustment of the hinge pin (1).

Figure 4:
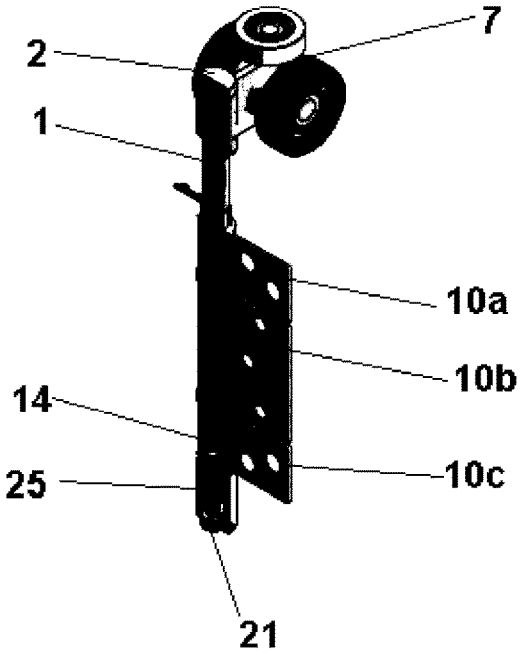
FIG. 4 is a perspective view of the sectioned device of FIG. 3.

FIG. 4 is a perspective view of the sectioned device of FIG. 3.

Figure 5:
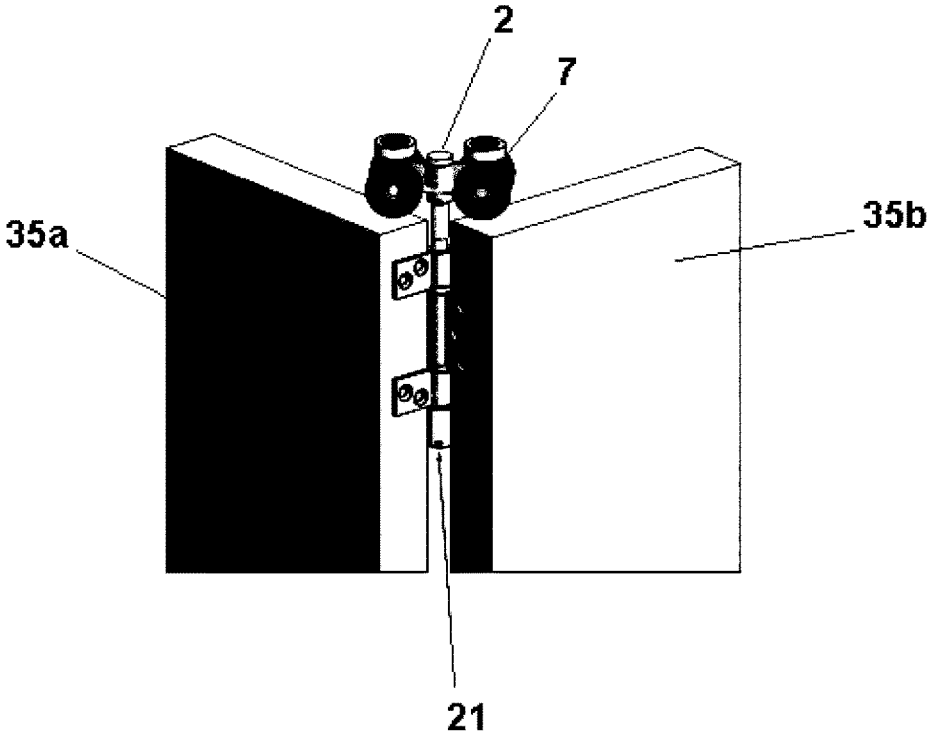
FIG. 5 illustrates the assembled device of FIG. 1 attached to the upper edges of two panels of a folding door.

FIG. 5 illustrates the assembled device of FIG. 1 attached to the upper edges of two panels (35*a*, 35*b*) of a folding door. Two hinge leaves (10*a*, 10*c*) are attached to the edge of a first panel (35*a*) and one hinge leaf (10*b*) is attached to the edge of a second panel (35*b*). The orientation of the fastener (21) is such that it cannot be accessed when the folding door is closed and the edges of the panels (35*a*, 35*b*) abut. The fastener (21) can only be accessed when the door is open and the panels (35*a*, 35*b*) are no longer abutting, or a preferably stacked to one side of a door frame.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures.

It should be noted that where the terms "server", "secure server" or similar terms are used herein, a communication device is described that may be used in a communication system, unless the context otherwise requires, and should not be construed to limit the present invention to any particular communication device type. Thus, a communication device may include, without limitation, a bridge, router, bridge-router (router), switch, node, or other communication device, which may or may not be secure.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

The invention claimed is:

1. A hinge adapted for use in conjunction with a trolley adapted to travel along a track, the hinge comprising:

a hinge pin, at least one hinge leaf adapted to engage a proximate structure and rotate about the hinge pin, the hinge pin having a first end depending from the trolley and a second end having a threaded axial recess, a threaded adjustment member that is rotatably received within the threaded axial recess of the hinge pin for displacement of the hinge pin relative to the at least one hinge leaf, a locking collar fitted around the second end of the hinge pin, the locking collar being keyed to the hinge pin so as to prevent axial rotation of the locking collar relative to the hinge pin, the locking collar comprising a threaded recess extending through a side wall thereof and toward a side of the threaded adjustment member, and a threaded fastener rotatable within the threaded recess of the locking collar so as to be brought into and out of contact with the adjustment member so as to alternately fasten and release the adjustment member, wherein, the locking collar is keyed to the hinge pin such that the orientation of threaded recess extending through the wall of the locking collar is fixed.

2. The hinge according to claim 1 wherein the locking collar is releasably fixable in the orientation of the threaded recess to limit access to the fastener.

3. The hinge according to claim 1 wherein the locking collar is removably attached to the second end of the hinge pin by a keyway and correspondingly shaped key.

4. A method of adjusting a hinge adapted for use in conjunction with a trolley adapted to travel along a track, the hinge comprising:

a hinge pin, at least one hinge leaf adapted to engage a proximate structure and rotate about the hinge pin, the hinge pin having a first end depending from the trolley and a second end having a threaded axial recess, a threaded adjustment member that is rotatably received within the threaded axial recess of the hinge pin for displacement of the at least one hinge leaf relative to the trolley, a locking collar fitted around the second end of the hinge pin, the locking collar being keyed to the hinge pin so as to prevent axial rotation of the locking collar relative to the hinge pin, the locking collar comprising a threaded recess extending through a side wall thereof and toward a side of the threaded adjustment member, and a threaded fastener rotatable within the threaded recess of the locking collar so as to be brought into and out of contact with the adjustment member so as to alternately fasten and release the adjustment member, wherein, the locking collar is keyed to the hinge pin such that the orientation of threaded recess extending through the wall of the locking collar is fixed the method comprising:

(i) releasing the fastener from the threaded adjustment member, (ii) operating the threaded adjustment member to move the hinge pin vertically to a desired position, and (iii) applying the fastener to secure the threaded adjustment member.

* * * * *